US005746587A

United States Patent [19]

Racine et al.

[11] Patent Number: 5,746,587

[45] Date of Patent: May 5, 1998

[54] LIGHTER ATTACHABLE TO A CIGARETTE PACKET

[76] Inventors: Roland Racine, deceased, late of Avully; by Francine Racine, legal representative, 40 rue de Geneve, 1225 Chene-Bourg, Geneva; Gian Lanoir, 40 route de Chene, CH-1225 Chene-Bourg, all of Switzerland

[21] Appl. No.: 104,145

[22] PCT Filed: Dec. 17, 1991

[86] PCT No.: PCT/EP91/02463

§ 371 Date: Apr. 26, 1995

§ 102(e) Date: Apr. 26, 1995

[87] PCT Pub. No.: WO92/10950

PCT Pub. Date: Jul. 9, 1992

[51] Int. Cl.[6] ..... A24F 15/18

[52] U.S. Cl. ..... 431/253; 431/343; 206/85; 206/87

[58] Field of Search ..... 431/253; 206/89, 206/85, 86, 87

[56] References Cited

U.S. PATENT DOCUMENTS

| | | | |
|---|---|---|---|
| 1,831,014 | 11/1931 | Leitheuser . | |
| 1,862,518 | 3/1932 | Alland | 431/253 |
| 2,033,184 | 3/1936 | Dion . | |
| 2,116,292 | 5/1938 | Wakefield | 431/253 |
| 2,529,150 | 11/1950 | Fukal . | |
| 2,782,910 | 2/1957 | Leibow . | |
| 3,057,180 | 10/1962 | Steppan | 431/253 |
| 3,069,886 | 12/1962 | Coats | 431/253 |
| 3,178,016 | 4/1965 | Coats | 431/253 |
| 3,883,289 | 5/1975 | Fujioka | 431/255 |
| 4,149,843 | 4/1979 | Hekker et al. | 431/255 |
| 4,223,784 | 9/1980 | Kaneyasu . | |
| 4,385,689 | 5/1983 | Olazabal . | |
| 4,750,613 | 6/1988 | Kopp . | |
| 4,844,254 | 7/1989 | Jang | 431/253 |
| 5,409,374 | 4/1995 | Liard | 431/253 |

FOREIGN PATENT DOCUMENTS

| | | |
|---|---|---|
| 7825885 | 4/1979 | France . |
| 1435657 | 5/1976 | United Kingdom . |
| 2015136 | 9/1979 | United Kingdom . |
| 2199727 | 7/1988 | United Kingdom . |

*Primary Examiner*—Carl D. Price

*Attorney, Agent, or Firm*—Varnum, Riddering, Schmidt & Howlett LLP

[57] ABSTRACT

A lighter provided with a means for receiving a packet of cigarettes in a detachable fashion. It consists of a lighter body (1) with at least two sides (9, 10, 11) extended to take a cigarette packet (P). These elongated sides can be completed with additional extensions forming a case in which to place a packet of cigarettes.

6 Claims, 3 Drawing Sheets

LIGHTER ATTACHABLE TO A CIGARETTE PACKET

BACKGROUND OF THE INVENTION

1. Field of the Invention

The present invention relates to a lighter, and in particular a lighter provided with a means for receiving a packet of cigarettes in a detachable fashion.

2. Description of Prior Art

It is well known that cigarette smokers often forget or lose their lighters, as they are separate from the cigarette packet which they have less tendency to forget or lose. It is also well known that smokers are often faced with the problem of the simultaneous availability of their packet of cigarettes and a means of lighting them, the matchbox or lighter often being mislaid or lost by their owner, as opposed to the packet of cigarettes. The aim of this invention is therefore to supply an item for use as a lighter and/or case for receiving a cigarette packet which may be easily fixed to a packet of cigarettes, so as to reduce the risk of losing or forgetting it. The said item may be of the disposable type and must therefore not be too expensive.

SUMMARY OF THE INVENTION

The lighter invented, which aims to achieve the above quoted aim, and which is therefore intended to be detachably fixed on to a packet of cigarettes, and is typified by the fact that it consists of a lighter body and at least two sides extended along the length of the two parallel surfaces of the said body, and by the fact that these sides form or are provided with means of fixation fitting it when in position on to the cigarette packet.

BRIEF DESCRIPTION OF DRAWING

The attached drawing illustrates some embodiments of the invention diagrammatically and by way of example.

DESCRIPTION OF PREFERRED EMBODIMENTS

Figure 1:
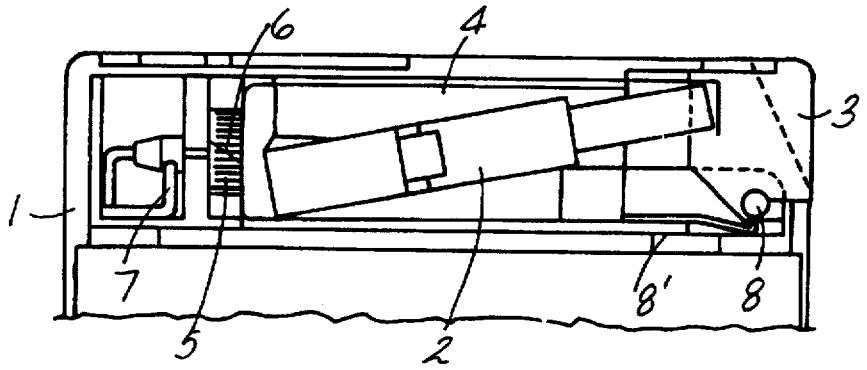
FIGS. 1 and 2 are partial views in the vertical and horizontal sections respectively of a particular type of lighter body.
Figure 2:
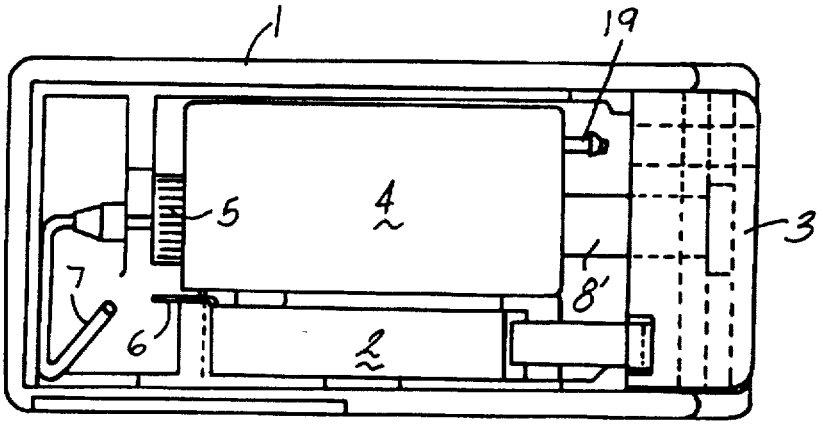

Referring first of all to FIGS. 1 and 2, a specific embodiment of the lighter body is described. This is preferably of the piezoelectrical type, the principle of which is well known. On the other hand, contrary to normal lighters in which the body is vertically disposed with the flame burning in the direction of the said body when in operation, the body of the lighter illustrated is a relatively flat parallelepiped and horizontally disposed, so as to occupy a minimum of space heightwise, and in which the flame is perpendicular to the plane of the said body.

As illustrated in FIGS. 1 and 2, the lighter body (1) consists of a piezoelectrical lighting module (2), activated by a push button (3), a supply of gas (4), an inlet valve (5) with flame adjustment, a high voltage lighting electrode (6), and a gas outlet nozzle with a duct (7) for the flame, directed perpendicular to the body of the lighter (1). In the case of a non-disposable lighter, a filling valve (1)9 to the gas supply (4) can be provided, accessible from the outside.

It should be noted that the push button (3) is fitted to pivot about a transversal axis 8 and takes up almost all the width of the lighter body, particularly the upper edge of one of the small sides. Pressure on the push button (3) acts on a cam (8') and makes the gas container (4) retract and opens the gas outlet valve (5). At the same time, the button (3) arrives at a position which activates the piezoelectrical device (2) and causes the gas to ignite as it comes out of duct (7), the ignition spark being produced between the end of duct (7) through which the gas comes out, and which is electrically linked to the piezo device by solid contacts with the case (1), and the high voltage electrode (6). Button (3) returns to its rest position due to the spring back effect of the piezo device (2) and closes the gas exit valve.

Figure 3:
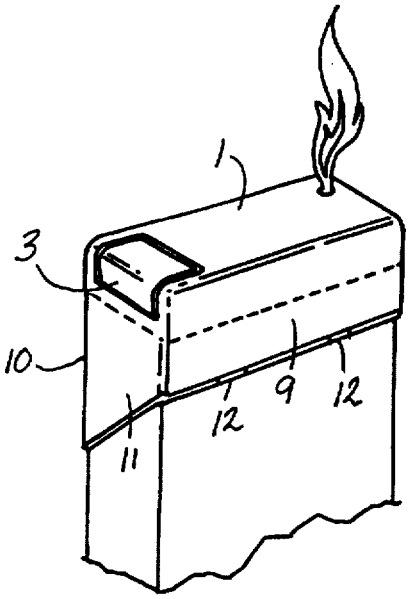
FIGS. 3 and 4 are perspective views of the front and back showing one example of the lighter attached to a packet of cigarettes (partially shown).
Figure 4:
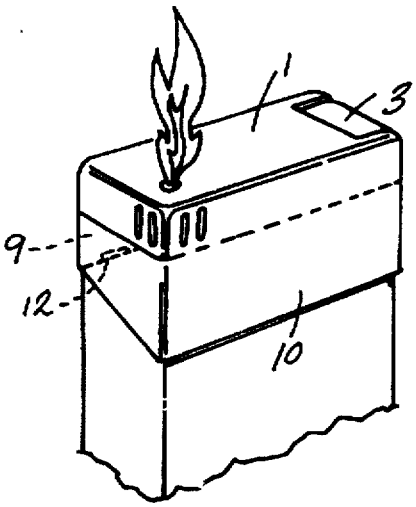

A first embodiment of the invented lighter, shown in FIGS. 3 and 4, consists of a lighter body (1) such as described above, in which the vertical sides are extended by lateral sides at the back (9), at the front (10) and at the side (11) forming a sort of skirt forming a case. This skirt is intended to be fixed into the upper part of a packet of cigarettes P by gentle friction especially a packet of the box type with upper opening flap (partially shown by thin lines).

In this embodiment, the lighter is fixed on the cigarette packet partly by the elasticity of the sides (9), (10), (11) and partly due to grips (12) which, in the coupled position, are inserted into the cigarette box P, at upper hinge level.

Preferably, the lighter body (1) is made from an appropriate plastics material, whereas the sides (9), (10), (11) are made from fine sheet steel (about 0.3 mm), which confers the required elasticity on the skirt formed by the side walls (9), (10), (11). Naturally the lighter body can also be from fine sheet steel or indeed the whole of the lighter can be of plastics material.

Figure 5:
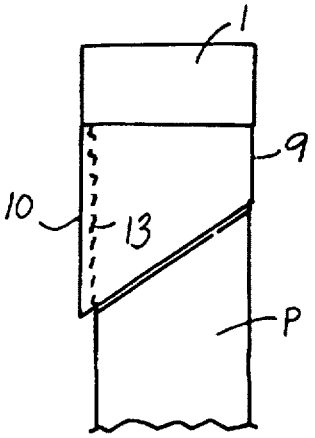
FIGS. 5 to 7 are simplified views showing three different embodiments of means for fixation.
Figure 6:
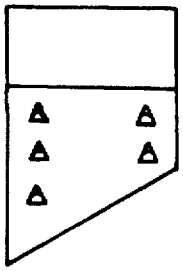

Two variations for fixing the lighter on to the cigarette packet are shown in FIGS. 5 and 6.

In the first variation (FIG. 5), one of the sides, here for example the front wall (10), has a strip of grooved flexible rubber (13) fitted on its internal surface; the invented lighter is therefore kept in a fixed position on the cigarette box flap P by friction and compression provided by the strip of rubber (13).

According to another variation (FIG. 6) another means of fixing can be formed by grips (14), produced by stamping and projecting inside the sides (11) and when in the use position fitting into the upper sides of the cigarette packet or gripping them. These grips (14) can also be use as a means of compensation, bearing in mind that the standard width of cigarette boxes can vary between about 55 and 58 mm. According to one variation (not illustrated), similar grips can be provided, but these may be vertically orientated from top to bottom from the base of the lighter body (1), these grips seizing in the use in the upper wall of the box flap.

Figure 7:
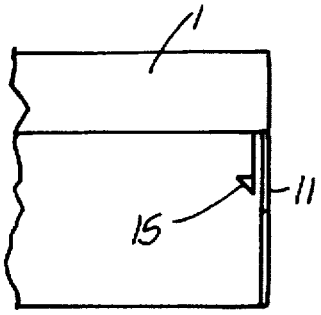
Figure 8:
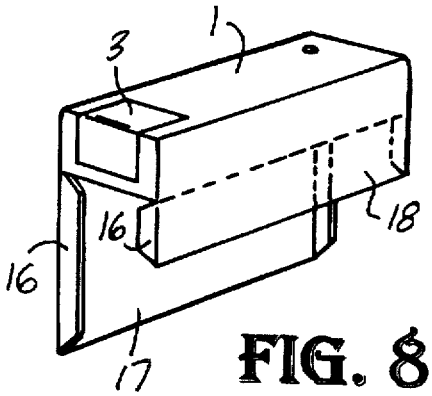
FIG. 8 is a perspective view of another example of the lighter.

FIGS. 7 and 8 illustrate other variations which include methods of compensating and adjusting, for example, elastic straps (15) (FIG. 7), placed vertically and fixed on to the lower surface of the lighter body (1) or even flexible vertical pleats (16) which can be seen on the sides at the front (17) and the back (10).

In other embodiments which are not illustrated, the methods of fixing can also be formed by a double sided adhesive strip (with non-permanent adhesion) stuck for example on to the lower side of the lighter body. In addition, as a means of compensating for the differences in cigarette packet width, it is also possible to provide a form, similar to that in FIG. 1, but one in which one of the sides (11) is totally absent, i.e. is detachable and can be inserted laterally against the small side of the cigarette packet.

All the types described up to now, referring to FIGS. 3 to 8 are intended to be fitted in operational position on the opening flap of a box type cigarette packet, and thus enabling the smoker to open the said box leaving the invented lighter fixed to the opening flap, with the sides of the said lighter having a similar shape to the said flap.

Figure 9:
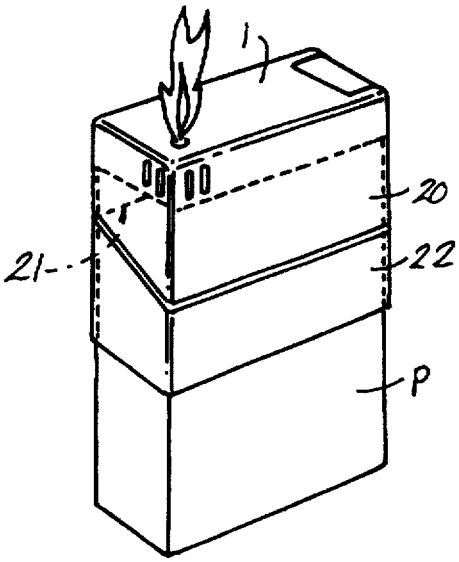
FIG. 9 is a perspective view of a particular type of lighter in which the lateral sides form a partial cigarette case.

In the example shown in FIG. 9, the lighter body (1) is elongated with an extension in a form analogous with the upper part of a cigarette box, i.e. comprising an opening flap (20) pivoting about a transversal hinge (21), the lower skirt (22) fixing over the box P beneath the opening flap of the said box.

Figure 10:
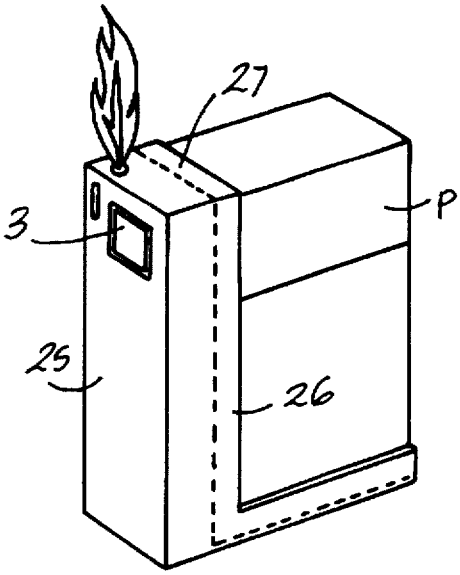
FIG. 10 is a perspective view of another special type of lighter in which the lighter body is fitted in vertical position to the packet of cigarettes.

FIG. 10 shows an embodiment in which the lighter body (25) differs from the other forms previously described, in the sense that it is vertically orientated and that the flame is directed, as in normal lighters, along the longitudinal axis of the said body, and not perpendicular to the plane of the lighter. In this embodiment the larger sides of the lighter body (25) are extended by sides (26) in the shape of an L, whereas the small sides of the lighter body (25) are extended by sides (27) forming an L-shaped housing with sides (26), to take a cigarette packet P, which is kept in this housing by fitting in simply by gentle friction, obtained purely by the elasticity of sides (26), (27).

Figure 11:
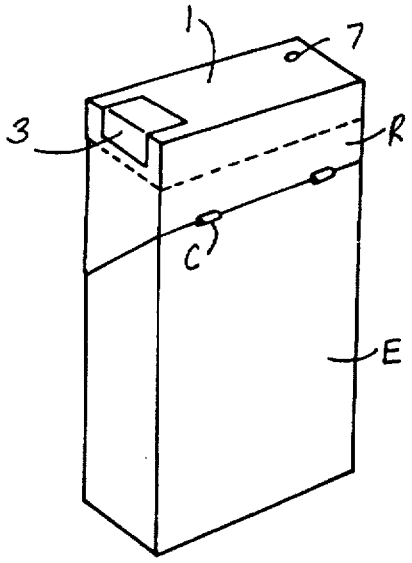
FIG. 11 is a general perspective view of yet another embodiment of the invention.

With reference to FIG. 11 the embodiment shown in this figure shows a cigarette case for cigarette packet E in the usual form provided with an upper part or flap R articulated on hinges C.

The upper end of the flap R is extended upwards by lighter body (1) of the horizontal type.

Figure 12:
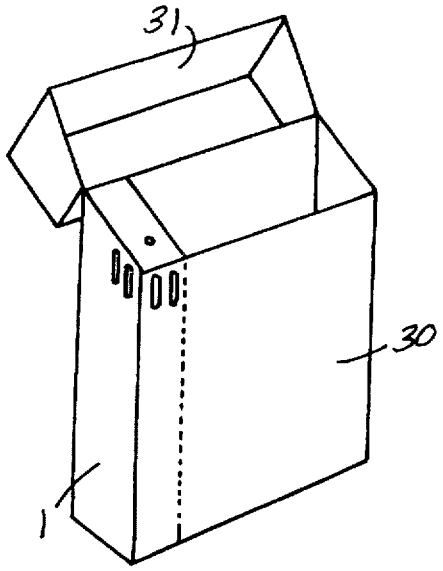
FIG. 12 is a general perspective view of another embodiment in the form of a cigarette case.

In the embodiment shown in FIG. 12, the lighter body (1) is vertical, as the sideways extension of a case (30) in the usual parallelepipedic shape. A flap (31) also in the normal shape is provided, covering the entire width of the case (11) combined with the lighter (1).

Although the lighter (1) can include a traditional lighting device activated by a push button accessible from the outside, the invention also relates to a special form in which the lid or flap opens (31), activating the lighting device.

Figure 13:
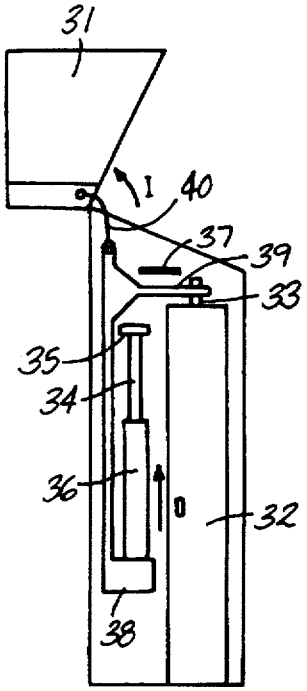
FIGS. 13 and 14 are diagrammatic views from the side showing a lighting mechanism as in FIG. 12, in intermediate open position and open operating position respectively.
Figure 14:
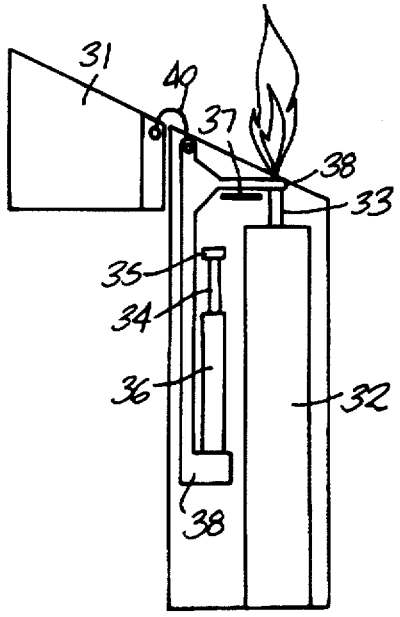

FIGS. 13 and 14 show diagrammatically an example of a possible embodiment of this special lighting device.

This device comprises a gas supply (32) provided at its upper end with a gas outlet nozzle (33) incorporating a valve and mounted vertically in a detachable manner to open it, together with a piezoelectrical lighting system comprising a male element (34), working in tandem with a fixed stop (35) a female element (36), and a high voltage electrode (37). The female element (36) of the piezo system is fitted vertically in a detachable fashion and works in random with an actuator (38), which has a fork (39) claimed with the nozzle valve (31) on its upper part and has a semi rigid hinge (40) on its upper edge, the other end being fixed to the flap (31).

Thus, when the user opens the lid or flap (31) of the case (30), he causes the semi-rigid hinge (40) to move in the direction of arrow I, causing the actuator (38) to slide upwards in the direction of arrow II, and thus of the female part (36) of the piezoelectrical system. This female part (36) therefore comprises the fixed male part (34) and causes the electrode (37) to spark. The vertical movement of the actuator (38) is simultaneously drawn towards the top of nozzle (33), by way of fork (39), and thus opens the gas outlet valve, which is lighted by the said spark. Return to rest position is obtained on the one hand by the spring back effect of the piezo system and by closing the hinge (31), on the other.

In this way, the smoker has less chance of losing or forgetting his lighter, which, according to the invention, can be attached to or can receive a packet of cigarettes in a detachable fashion.

It is claimed:

1. A lighter adapted to receive and retain in a detachable manner a cigarette packet having an upper flap, the lighter comprising a lighter body forming a parallelepiped comprising an upper surface and a pair of long sides formed integral with the upper surface and extending parallel to a longitudinal axis of the upper surface and a pair of relatively shorter sides formed integral with the upper surface and extending parallel to a transverse axis of the upper surface, at least two parallel sides of the lighter body being extended to receive the cigarette packet, one of the at least two extended sides being extended by a predefined distance and another of the at least two extended sides being extended by a distance greater than the predefined distance to receive the cigarette packet, the at least two extended sides having a predetermined elasticity and provided with grips for holding the cigarette packet, whereby the lighter can be fitted onto an upper flap of the cigarette packet and retained on the cigarette packet.

2. A lighter provided with a lighter body for receiving a cigarette packet in a detachable manner, the lighter body having the form of a parallelepiped and comprising:

a flat upper surface extending in a plane and at least two sides extending from the upper surface for receiving the cigarette packet;

a flame outlet opening in the flat upper surface and extending in a direction perpendicular to the plane of the upper surface; and a lighting device disposed under the flat upper surface and communicating with the flame outlet opening for providing a flame through the opening;

the upper surface having a longitudinal axis and a transverse axis and the lighter body having long sides extending parallel to the longitudinal axis and short sides extending parallel to the transverse axis; and a push button mounted pivotally along an axis extending parallel to the transverse axis and forming an upper corner of one of the short sides, the push button operative to activate the lighting device.

3. The lighter in accordance with claim 2 wherein the lighting device comprises a gas outlet tube communicating with the flame outlet opening and a piezoelectric device comprising a high voltage ignition electrode and ground contacts connected to the gas outlet tube.

4. A lighter provided with a lighter body having means for receiving a cigarette packet in a detachable manner, the means for receiving comprising at least two extended sides of the lighter body extending from two parallel surfaces of the lighter body and forming means for fixation cooperating with the cigarette packet, the lighter body having the form of a parallelepiped and comprising an upper surface extending in a plane and long sides extending parallel to a longitudinal axis of the upper surface and short sides extending parallel to a transverse axis of the upper surface, the transverse axis extending perpendicular to the longitudinal axis, the upper surface comprising a flame outlet extending in a direction perpendicular to the plane of the upper surface, the lighter further comprising a push button mounted pivotally along an axis extending parallel to the transverse axis and forming an upper corner of one of the short sides of the lighter body, a gas container, a fixed gas outlet valve and a rod engaging the gas container, the push button operative to activate the rod to cause the gas container to move in relation to the fixed gas outlet valve.

5. The lighter in accordance with claim 1 wherein the sides are formed of a plastic material.

6. The lighter in accordance with claim 1 wherein the sides are formed of sheet steel.

* * * * *